US008018405B2

(12) United States Patent
Kwak et al.

(10) Patent No.: US 8,018,405 B2
(45) Date of Patent: Sep. 13, 2011

(54) ORGANIC LIGHT EMITTING DISPLAY DEVICE WITH REDUCED VARIATION BETWEEN LIFE TIMES OF ORGANIC LIGHT EMITTING DIODES AND DRIVING METHOD THEREOF

(75) Inventors: Won Kvu Kwak, Seongnam (KR); Komiya Naoaki, Ulsan (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 930 days.

(21) Appl. No.: 11/519,730

(22) Filed: Sep. 11, 2006

(65) Prior Publication Data

US 2007/0103405 A1 May 10, 2007

(30) Foreign Application Priority Data

Nov. 4, 2005 (KR) ..... 10-2005-105699

(51) Int. Cl.
*G09G 3/32* (2006.01)

(52) U.S. Cl. ..... 345/82; 345/83

(58) Field of Classification Search ..... 345/76, 345/77, 82, 83
See application file for complete search history.

(56) References Cited

U.S. PATENT DOCUMENTS

| | | | | |
|---|---|---|---|---|
| 5,748,160 | A | 5/1998 | Shieh et al. | |
| 6,184,853 | B1 | 2/2001 | Hebiguchi et al. | |
| 6,421,033 | B1 | 7/2002 | Williams et al. | |
| 6,583,775 | B1 | 6/2003 | Sekiya et al. | |
| 6,618,031 | B1 | 9/2003 | Bohn, Jr. et al. | |
| 7,227,517 | B2 | 6/2007 | Imamura | |
| 7,768,482 | B2 * | 8/2010 | Kwak | 345/76 |
| 7,804,466 | B2 * | 9/2010 | Kwak et al. | 345/76 |
| 2002/0043941 | A1 | 4/2002 | Iketsu et al. | |
| 2003/0214493 | A1 | 11/2003 | Akimoto et al. | |
| 2005/0017934 | A1 * | 1/2005 | Chung et al. | 345/82 |
| 2005/0104875 | A1 * | 5/2005 | Kwak et al. | 345/204 |

(Continued)

FOREIGN PATENT DOCUMENTS

CN 1577453 A 2/2005

(Continued)

OTHER PUBLICATIONS

European Search Report dated Nov. 22, 2007, for corresponding European Patent Application EP 06255680.8, indicating relevance of references in this IDS.*

(Continued)

*Primary Examiner* — Chanh Nguyen
*Assistant Examiner* — Kwang-Su Yang
(74) *Attorney, Agent, or Firm* — Christie, Parker & Hale, LLP

(57) ABSTRACT

An organic light emitting diode (OLED) display device and a method for driving the OLED display device are provided. A gate drive circuit provides scan signals in sub-frames to scan lines. A data drive circuit provides a data signal to data lines. An emission control signal generation circuit provides first and second emission control signals to control the OLEDs. A display region includes pixels arranged in a matrix and connected to the scan lines, data lines, emission control lines, and power lines. The pixels include a first and a second unit pixel portion. The first unit pixel portion performs a time division control drive by driving a plurality of organic light emitting diodes by one shared pixel circuit. In the second unit portion one organic light emitting diode is driven by an independent pixel circuit.

30 Claims, 6 Drawing Sheets

U.S. PATENT DOCUMENTS

| | | | | |
|---|---|---|---|---|
| 2005/0110723 | A1* | 5/2005 | Shin | 345/76 |
| 2005/0200573 | A1* | 9/2005 | Kwak | |
| 2005/0242712 | A1* | 11/2005 | Sung | 313/503 |
| 2006/0066528 | A1* | 3/2006 | Hara | 345/76 |
| 2006/0097966 | A1* | 5/2006 | Choi | 345/77 |
| 2006/0103611 | A1* | 5/2006 | Choi | 345/82 |
| 2007/0138947 | A1* | 6/2007 | Popovic et al. | 313/504 |

FOREIGN PATENT DOCUMENTS

| | | | |
|---|---|---|---|
| CN | 1622723 | A | 6/2005 |
| EP | 0 762 374 | A1 | 3/1997 |
| EP | 1 496 495 | A2 * | 1/2005 |
| EP | 1 531 452 | A1 | 5/2005 |
| EP | 1 536 406 | B1 * | 6/2005 |
| JP | 02-073292 | | 3/1990 |
| JP | 06-124069 | | 5/1994 |
| JP | 09-138659 | | 5/1997 |
| JP | 10-333639 | | 12/1998 |
| JP | 2002-072980 | | 3/2002 |
| JP | 2002-149129 | | 5/2002 |
| JP | 2002-297083 | | 10/2002 |
| JP | 2003-510661 | | 3/2003 |
| JP | 2003-122306 | | 4/2003 |
| JP | 2005-148749 | | 6/2005 |
| JP | 2005-148750 | | 6/2005 |
| JP | 2005-148751 | | 6/2005 |
| JP | 2005-157258 | | 6/2005 |
| JP | 2005-157267 | | 6/2005 |
| WO | WO 01/24153 | A1 | 4/2001 |

OTHER PUBLICATIONS

Office action dated May 9, 2008 for corresponding Chinese Patent Application No. 200610143369.3 indicating relevance of the cited references.

U.S. Office action dated May 13, 2008 for related U.S. Appl. No. 11/055,400, indicating relevance of listed reference in this IDS.

Patent Abstracts of Japan, Publication No. 09-138659, dated May 27, 1997, in the name of Chan-Long Shieh et al.

Patent Abstracts of Japan, Publication No. 10-333639, dated Dec. 18, 1998, in the name of Junpei Hashiguchi.

Patent Abstracts of Japan, Publication No. 2002-072980, dated Mar. 12, 2002, in the name of Masao Imai.

Patent Abstracts of Japan, Publication No. 2002149129, dated May 25, 2002, in the name of Atsushi Yamanaka.

Patent Abstracts of Japan, Publication No. 2002-297083, dated Oct. 9, 2002, in the name of Hideto Kitakado et al.

Patent Abstracts of Japan, Publication No. 2003-122306, dated Apr. 25, 2003, in the name of Akira Yumoto.

Japanese Office action dated Mar. 24, 2009, for corresponding Japanese application 2006-038395, noting listed references in this IDS, and JP 2003-122306 in the Feb. 20, 2008 IDS.

U.S. Office action dated Aug. 11, 2009, for related U.S. Appl. No. 11/055,441, noting listed U.S. Patent in this IDS.

* cited by examiner (PRIO ART)

ORGANIC LIGHT EMITTING DISPLAY DEVICE WITH REDUCED VARIATION BETWEEN LIFE TIMES OF ORGANIC LIGHT EMITTING DIODES AND DRIVING METHOD THEREOF

CROSS-REFERENCE TO RELATED APPLICATION

This application claims priority to and the benefit of Korean Patent Application No. 10-2005-0105699, filed on Nov. 4, 2005, in the Korean Intellectual Property Office, the entire content of which is incorporated herein by reference.

BACKGROUND

1. Field of the Invention

The present invention relates to an organic light emitting display device and a driving method thereof, and more particularly to an organic light emitting display device and a driving method thereof, which solve problems due to a life time variation of red, green, and blue organic light emitting diodes.

2. Discussion of Related Art

Recently, since liquid crystal display devices and organic light emitting display devices have lightweight and thinness characteristics, they have been widely used in a field of portable information devices. In particular, since light emitting display devices have greater useful temperature range, higher resistance to shock or vibration, a wider angle of visibility, and a higher response speed in comparison with other flat plate display devices including liquid crystal display devices, they have been proposed as the next-generation planar type display devices.

In general, in an active matrix type organic light emitting display device, one pixel includes R, G, and B unit pixels. Each of the R, G, and B unit pixels includes an organic light emitting diode. In each organic light emitting diode, an R, G, or B organic emission layer is sandwiched between an anode electrode and a cathode electrode. Light is emitted from the R, G, or B organic emission layer by a voltage applied to the anode electrode and the cathode electrode in the organic light emitting diode.

FIG. 1 is a block diagram showing a conventional active matrix type organic light emitting display device 10.

With reference to FIG. 1, the conventional active matrix type organic light emitting display device 10 includes a display region 100, a gate drive circuit 110, a data drive circuit 120, and a controller (not shown). The display region 100 includes a plurality of scan lines 111 to 11*m*, a plurality of data lines 121 to 12*n*, and a plurality of power supply lines 131 to 13*n*. Scan signals S1 to Sm from the gate drive circuit 110 are provided to the plurality of scan lines 111 to 11*m*. The plurality of data lines 121 to 12*n* provide data signals DR1, DG1, DB1 . . . DRn, DGn, and DBn. The plurality of power supply lines 131 to 13*n* provide source voltages VDD1 to VDDn.

The display region 100 includes a plurality of pixels P11 to Pmn. The plurality of pixels P11 to Pmn, which are arranged in a matrix, are connected to the plurality of scan lines 111 to 11*m*, the plurality of data lines 121 to 12*n*, and the plurality of power supply lines 131 to 13*n*. Each of the pixels P11 to Pmn includes 3 unit pixels, namely, R, G, and B unit pixels PR11, PG11, PB11 . . . PRmn, PGmn, and PBmn, which are connected to one corresponding scan line, one corresponding data line, and one corresponding power supply line among the plurality of scan lines 111 to 11*m*, the plurality of data lines 121 to 12*n*, and the plurality of power supply lines 131 to 13*n*.

For example, a pixel P11 disposed at an upper left end of the display region 100 includes an R unit pixel PR11, a G unit pixel PG11, and a B unit pixel PB11. Further, the pixel P11 is connected to a first scan line 111 among the scan lines 111 to 11*m*, a first data line 121 among the data lines 121 to 12*n*, and a first power supply line 131 among the power supply lines 131 to 13*n*.

That is, an R unit pixel PR11 is connected to a first scan line 111, an R data line 121R among the first data lines 121 to which a data signal DR1 is provided, and an R power supply line 131R among first power supply lines 131. A G unit pixel PG11 is connected to the first scan line, a G data line 121G among the first data lines 121 to which a G data signal DG1 is provided, and a G power supply line 131G among first power supply lines 131. A B unit pixel PB11 is connected to the first scan line 111, a B data line 121B among the first data lines 121 to which a B data signal is provided, and a B power supply 131B among the first power lines 131.

FIG. 2 is a circuit diagram of each pixel in the conventional organic light emitting display device shown in FIG. 1, which shows a circuit arrangement of one pixel P11 configured by R, G, and B unit pixels.

Referring to FIG. 2, the R unit pixel PR11 includes a switching transistor M1_R, a drive transistor M2_R, a capacitor C1_R, and an R organic light emitting diode EL1_R. A scan signal S1 from the first scan line 111 is provided to a gate of the switching transistor M1_R, and a data signal DR1 from the R data line 121R is provided to a source of the switching transistor M1_R. A gate of the drive transistor M2_R is connected to a drain of the switching transistor M1_R, and a source voltage VDD1 from a power supply line 131R is provided to a source of the drive transistor M2_R. The capacitor C1_R is connected to the gate and source of the drive transistor M2_R. An anode of the R organic light emitting diode EL1_R is connected to a drain of the drive transistor M2_R, and a cathode thereof is connected to a ground voltage VSS.

In a similar manner, the G unit pixel PG11 includes a switching transistor M1_G, a drive transistor M2_G, a capacitor C1_G, and a G organic light emitting diode EL1_G. A scan signal S1 from the first scan line 111 is provided to a gate of the switching transistor M1_G, and a data signal DG1 from the G data line 121G is provided to a source of the switching transistor M1_G. A gate of the drive transistor M2_G is connected to a drain of the switching transistor M1_G, and a source voltage VDD1 from a power supply line 131G is provided to a source of the drive transistor M2_G. The capacitor C1_G is connected to the gate and source of the drive transistor M2_G. An anode of the G organic light emitting diode EL1_G is connected to a drain of the drive transistor M2_G, and a cathode thereof is connected to a ground voltage VSS.

Further, the B unit pixel PB11 includes a switching transistor M1_B, a drive transistor M2_B, a capacitor C1_B, and a B organic light emitting diode EL1_B. A scan signal S1 from the first scan line 111 is provided to a gate of the switching transistor M1_B, and a data signal DB1 from the B data line 121B is provided to a source of the switching transistor M1_B. A gate of the drive transistor M2_B is connected to a drain of the switching transistor M1_B, and a source voltage VDD1 from a power supply line 131B is provided to a source of the drive transistor M2_B. The capacitor C1_B is connected to the gate and source of the drive transistor M2_B. An anode of the B organic light emitting diode EL1_B is connected to a drain of the drive transistor M2_B, and a cathode thereof is a ground voltage VSS.

In the operation of the display region 100, when a scan signal S1 is applied to the scan line 111, the switching transistors M1_R, M1_G, and M1_B of R, G, and B unit pixels in the pixel P11 are driven, and R, G, and B data signals DR1, DG1, and DB1 from R, G, and B data lines 121R, 121G, and 121B are applied to the drive transistors M2_R, M2_G, and M2_B, respectively.

The drive transistors M2_R, M2_G, and M2_B provide a drive current corresponding to a difference between the data signals DR1, DG1, and DB1 applied to the gates thereof and the source voltage VDD1 provided from the R, G, and B power lines 131R, 131G, and 131B, to the organic light emitting diodes EL1_R, EL1_G, and EL1_B, respectively. The organic light emitting diodes EL1_R, EL1_G, and EL1_B are driven by the drive current applied through the drive transistors M2_R, M2_G, and M2_B to drive the pixel P11. The capacitors C1_R, C1_G, and C1_B are used to store the data signals DR1, DG1, and DB1 applied to the R, G, and B data lines 121R, 121G, and 121B.

An operation of the conventional organic light emitting display device having a construction mentioned above will be described with reference to a drive waveform of FIG. 3.

First, when the scan signal S1 is applied to the first scan line 111, the first scan line 111 is driven, and pixels P11 to P1*n* connected to the first scan line 111 are driven.

That is, switching transistors of R, G, and B unit pixels PR11 to PR1*n*, PG11 to PG1*n*, and PB11 to PB1*n* of the pixels P11 to P1*n* connected to the first scan line 111, are driven by the scan signal S1 applied to the first scan line 111. According to driving of the switching transistors, R, G, and B, data signals D(S1) including DR1 to DRn, DG1 to DGn, and DB1 to DBn from R, G, and B data lines 121R to 12*n*R, 121G to 12*n*G, and 121B to 121*n*B, constituting the first to $n^{th}$ data lines 121 to 12*n*, are concurrently applied to gates of drive transistors in the R, G, and B unit pixels, respectively.

The drive transistors of the R, G, and B unit pixels provide drive currents corresponding to R, G, and B data signals D(S1) including DR1 to DRn, DG1 to DGn, and DB1 to DBn respectively applied to R, G, and B data lines 121R to 12*n*R, 121G to 12*n*G, and 121B to 121*n*B, to R, G, and B organic light emitting diodes, respectively. Accordingly, when a scan signal S1 is applied to the first scan line 111, organic light emitting diodes constituting the R, G, and B unit pixels PR11 to PR1*n*, PG11 to PG1*n*, and PB11 to PB1*n* of the pixels P11 to P1*n* connected to the first scan line 111, are concurrently driven.

In the same manner, when a scan signal S2 for driving the second scan line 112 is applied, data signals D(S2) including DR1 to DRn, DG1 to DGn, and DB1 to DBn from R, G, and B data lines 121R to 12*n*R, 121G to 121*n*G, and 121B to 121*n*B constituting first to $n^{th}$ data lines 121 to 12*n*, are respectively applied to R, G, and B unit pixels PR21 to PR2*n*, PG21 to PG2*n*, and PB21 to PB2*n* of pixels P21 to P2*n* connected to a second scan line 112.

Organic light emitting diodes including R, G, and B unit pixels PR21 to PR2*n*, PG21 to PG2*n*, and PB21 to PB2*n* of pixels P21 to P2*n* connected to the second scan line 112 are concurrently driven by drive currents corresponding to the data signals D(S2) including DR1 to DRn, DG1 to DGn, and DB1 to DBn.

By repeating the above mentioned operation, a scan signal Sm is finally applied to an $m^{th}$ scan line 11*m*, according to data signals D(Sm) including DR1 to DRn, DG1 to DGn, and DB1 to DBn applied to the R, G, and B data lines 121R to 12*n*R, 121G to 121*n*G, and 121B to 12*n*B, organic light emitting diodes constituting R, G, and B unit pixels PRm1 to PRmn, PGm1 to PGmn, and PBm1 to PBmn of pixels Pm1 to Pmn connected to an $m^{th}$ scan line 11*m*, are concurrently driven.

Consequently, scan signals S1 to Sm are sequentially applied to the first scan line 111 to the $m^{th}$ scan line 11*m*. As a result, the pixels P11 to P1*n* through Pm1 to Pmn connected to scan lines 111 to 11*m* are sequentially driven to drive the pixels during one frame 1F, so that an image is displayed.

In the conventional organic light emitting display device having the configuration described above, each pixel includes three R, G, and B unit pixels. A driver, namely, a switching thin film transistor, a drive thin film transistor, and a capacitor are arranged in the R, G, and B unit pixels, and a data line and a common power line provide a data signal and a common power supply to the unit pixels.

According to a construction of the conventional organic light emitting display device, since each pixel includes three unit pixels, a plurality of wirings and a plurality of elements are arranged in every pixel, the circuit arrangement is complex, and it increases occurrence of defects, thereby deteriorating yield.

Moreover, as a display device is made with increasingly higher resolution, area of each pixel is reduced. Accordingly, it becomes difficult to arrange a plurality of elements in each pixel and the aperture ratio is reduced.

In addition, since organic light emitting diodes in R, G, and B unit pixels include emission layers formed by different materials, the life time of the organic light emitting diodes in different unit pixels are different from each other.

Accordingly, as time goes by, luminance reduction degrees are different in the R, G, and B unit pixels, thereby causing a white balance variation and an image sticking development.

SUMMARY OF THE INVENTION

Accordingly, it is an aspect of the present invention to provide an organic light emitting display device and a driving method thereof, which solve problems due to variation between the life time durations of red, green, and blue organic light emitting diodes by using a time division control drive method for organic light emitting diodes having a relatively longer life time and by using a general drive method for organic light emitting diodes having a relatively shorter life time.

According to a first aspect of the present invention, an organic light emitting display device is provided. The device comprises a gate drive circuit for generating scan signals and providing the scan signals to a plurality of scan lines, a data drive circuit for providing a data signal to a plurality of data lines when the scan signals are applied to the scan lines, an emission control signal generation circuit for generating first and second emission control signals and providing the first and second emission control signals to a plurality of emission control lines to control emission of organic light emitting diodes, and a display region including a plurality of pixels arranged in a matrix, the pixels coupled to the plurality of scan lines, the plurality of data lines, the plurality of emission control lines, and a plurality of power lines. Each of the plurality of pixels comprises a first unit pixel portion having a first pixel circuit and at least two of the organic light emitting diodes and a second unit pixel portion having a second pixel circuit and one of the organic light emitting diodes. The first unit pixel portion performs a time division control drive by sharing the first pixel circuit among the at least two of the organic light emitting diodes, and the second unit pixel portion drives the one of the organic light emitting diodes using the second pixel circuit.

According to a second aspect of the present invention, an organic light emitting display device comprising a gate drive circuit for generating scan signals and providing the scan signals to a plurality of scan lines, a data drive circuit for providing a data signal to a plurality of data lines when the scan signals are applied to the scan lines, an emission control signal generation circuit for generating first and second emission control signals and providing the first and second emission control signals to a plurality of emission control lines for controlling emission of organic light emitting diodes, and a display region including a plurality of pixels arranged in a matrix, the pixels coupled to the plurality of scan lines; the plurality of data lines, the plurality of emission control lines, and a plurality of power lines. Each of the plurality of pixels is divided into a first unit pixel portion and a second unit pixel portion according to whether the organic light emitting diodes in the pixel portions are driven time divisionally.

According to a third aspect of the present invention, there is provided a method for driving an organic light emitting display device including a pixel having first and second unit pixel portions, the first unit pixel portion including a first pixel circuit shared by at least two organic light emitting diodes, and the second unit pixel portion including a second pixel circuit driving one organic light emitting diode. The method comprises driving the first unit pixel portion by sequentially providing at least two data signals to the first unit pixel portion through a first data line in one frame; and driving the second unit pixel portion by providing a data signal, other than the at least two data signals provided to the first unit pixel portion, to the second unit pixel portion through a second data line in the one frame.

BRIEF DESCRIPTION OF THE DRAWINGS

These and/or other aspects and features of the invention will become apparent and more readily appreciated from the following description of the exemplary embodiments, taken in conjunction with the accompanying drawings of which.

DETAILED DESCRIPTION

Figure 1:
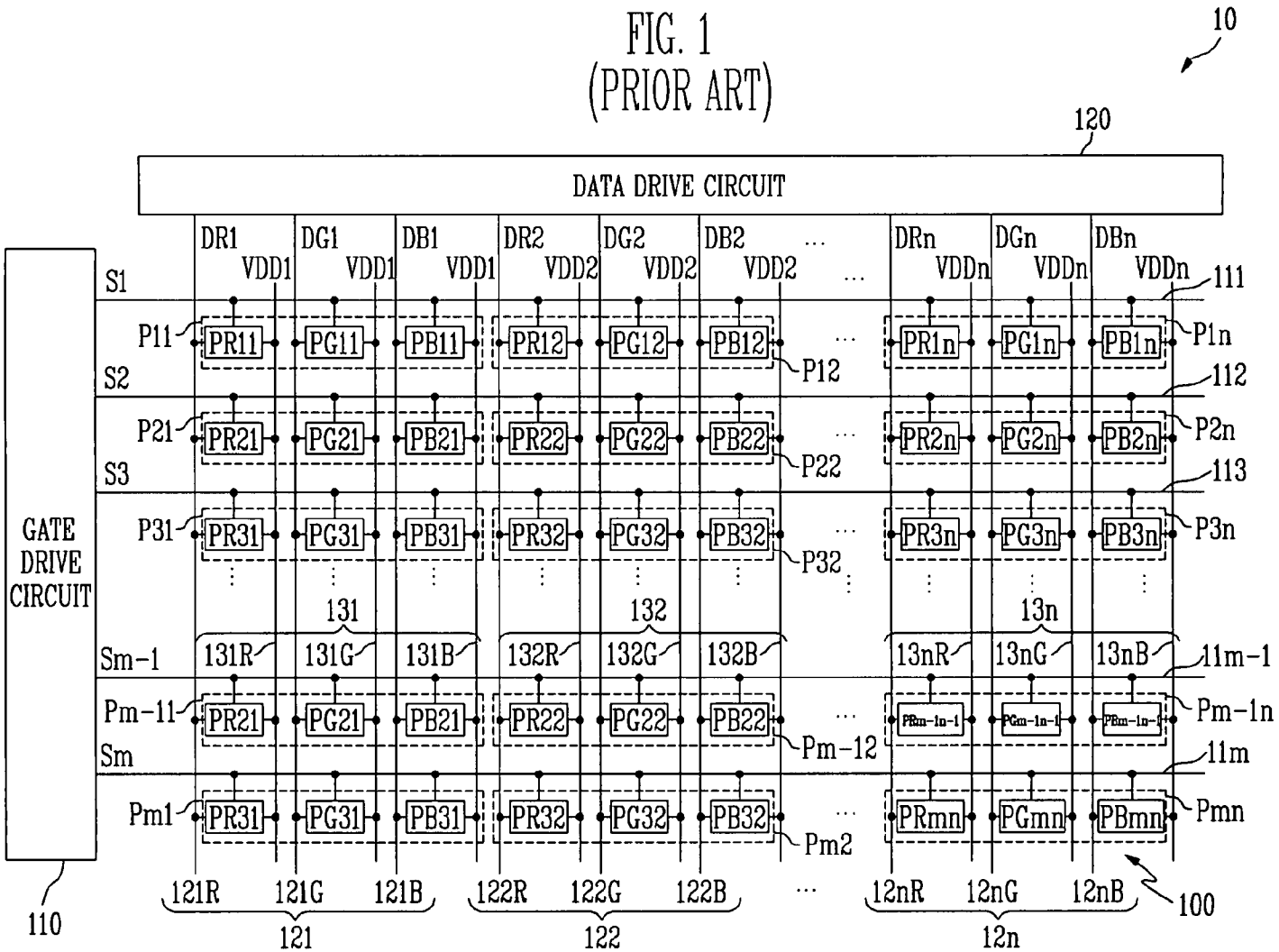
FIG. 1 (PRIOR ART)
FIG. 1 is a block diagram showing a conventional organic light emitting display device.
Figure 2:
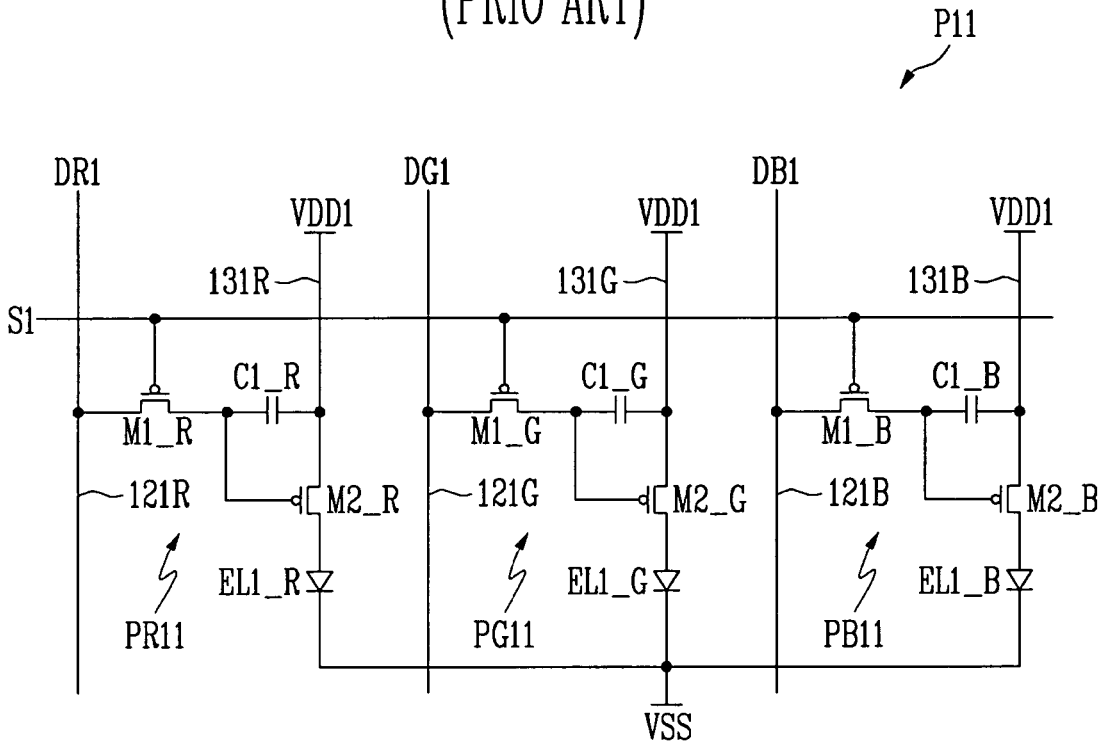
FIG. 2 is a circuit diagram of each pixel in the conventional organic light emitting display device shown in FIG. 1.
Figure 3:
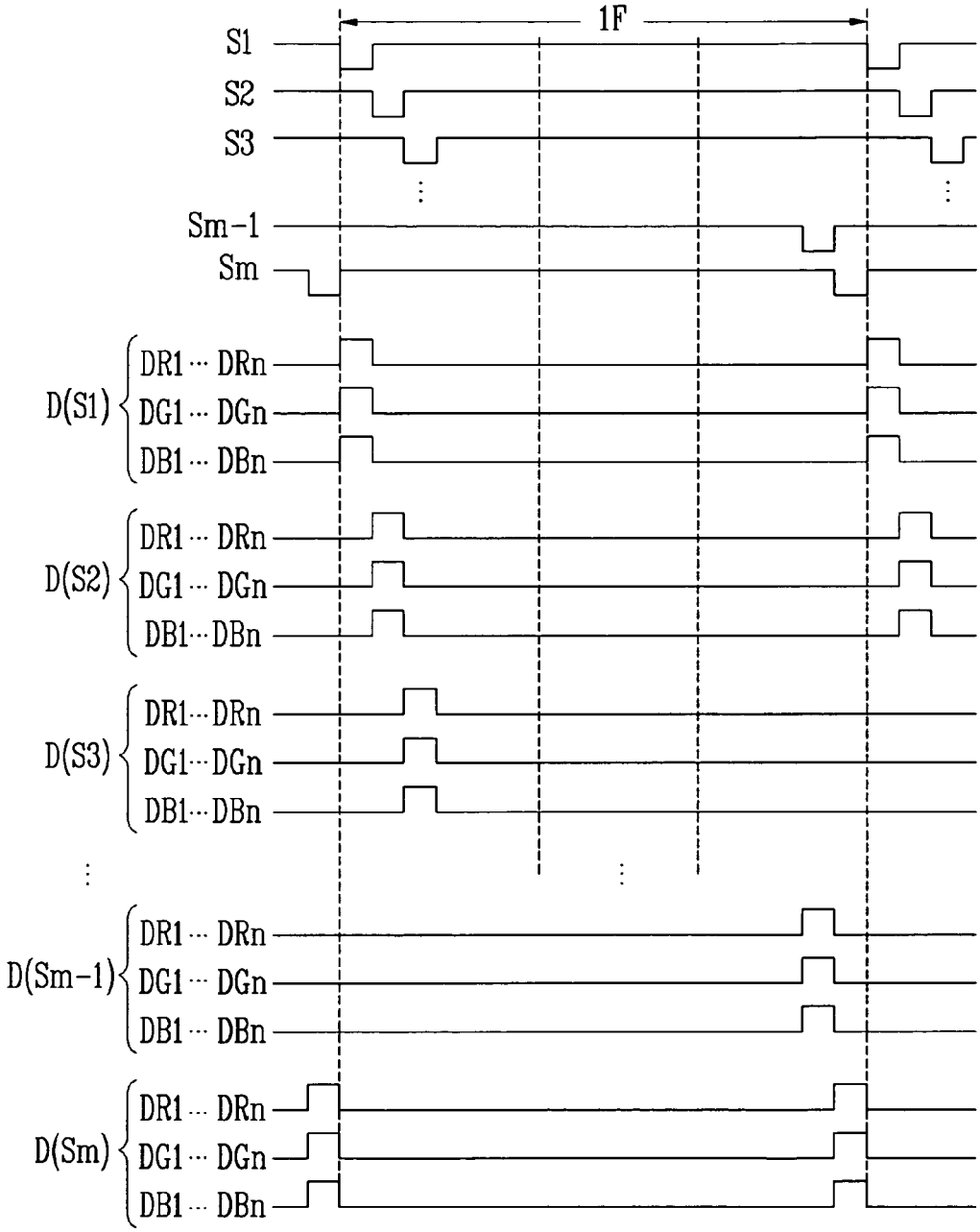
FIG. 3 is a waveform diagram illustrating an operation of each pixel shown in FIG. 2.

Hereinafter, exemplary embodiments according to the present invention will be described with reference to the accompanying drawings. Here, when one element is described to be connected to another element, the element may be directly connected to the other element or indirectly connected to the other element via one or more other elements. Further, some nonessential elements are omitted for clarity. Also, like reference numerals refer to like elements throughout.

Figure 4:
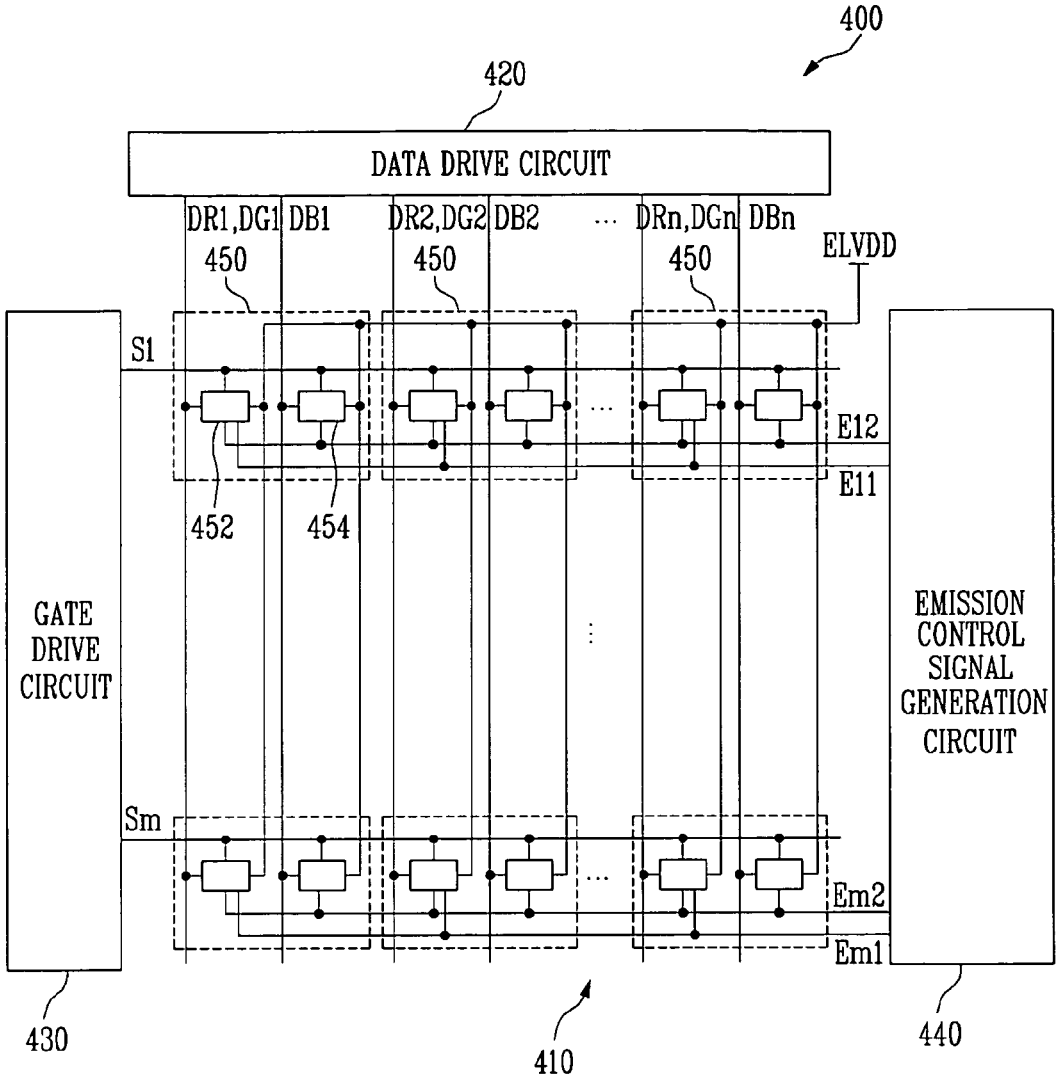
FIG. 4 is a block diagram showing a configuration of an organic light emitting display device according to an embodiment of the present invention.

FIG. 4 is a block diagram showing a configuration of an organic light emitting display device according to an embodiment of the present invention. The organic light emitting display device of FIG. 4 is one embodiment but the present invention is not limited thereto.

With reference to FIG. 4, the organic light emitting display device 400 according to an embodiment of the present invention includes a display region 410, a gate drive circuit 430, a data drive circuit 420, and an emission control signal generation circuit 440.

The gate drive circuit 430 provides scan signals S1 to Sm to a plurality of scan lines of the display region 410 during sub-frames.

Dividing one frame into predetermined blocks of time configures the sub-frames. In an embodiment of the present invention, one frame is divided by 2 to give two sub-frames.

Each time a scan signal is applied in sub-frames, the data drive circuit 420 provides R, G, and B data signals DR1 to DRn, DG1 to DGn, and DB1 to DBn to a data line of the display region 410.

In the described embodiment of the present invention, a pixel 450 includes R, G, and B organic light emitting diodes as an example. Organic light emitting diodes included in each pixel are driven by using a time division control drive method for organic light emitting diodes having a relatively longer life time, namely, R and G organic light emitting diodes, and by using a general drive method for organic light emitting diodes having a relatively shorter life time, namely, B organic light emitting diodes.

That is, the pixel 450 is divided into a first unit pixel portion 452 and a second unit pixel portion 454. The first unit pixel portion 452 uses a time division drive method by sharing one pixel circuit between the R and G organic light emitting diodes with a relatively longer life time. A B organic light emitting diode having the shortest life time is controlled by the second unit pixel portion 454 that is not driven by the time division drive method.

Accordingly, R and G data signals are sequentially provided to a data line connected to the first unit pixel portion 452 in sub-frames. When a scan signal is applied to a data line connected to the second unit pixel portion 454 in sub-frames, a B data signal is applied to the data line in the sub-frames.

Furthermore, the emission control signal generation circuit 440 provides emission control signals E11 to Em1 and E12 to Em2 to respective pixels, wherein the emission control signals (E11, E12) to (Em1, Em2) control an emission of each of the R, G, and B organic light emitting diode included in the unit pixel portions.

The emission control signals are divided into first emission control signals E11 to Em1 and second emission control signals E12 to Em2. The first emission control signals E11 to Em1 are signals that cause both the first and second unit pixel portions 452 and 454 to emit light in sub-frames, and are provided during a predetermined period of a sub-frame period as a special level (high or low level). The second emission control signals E12 to Em2 function to cause the first unit pixel portion 452 to sequentially emit light in sub-frames, and a voltage level thereof is inverted in consecutive sub-frames.

For example, when each of the first and second pixel portions 452 and 454 includes a PMOS transistor, the first emission control signals E11 to Em1 of low level are provided during the predetermined time period. In contrast, when each of the first and second pixel portions 452 and 454 includes an NMOS transistor, the first emission control signals E11 to Em1 of high level are provided during the predetermined time period.

Accordingly, in the first unit pixel portion 452, according to the first and second emission control signals, red and green organic light emitting diodes EL_R and EL_G sequentially emit light in sub-frames. In contrast, the blue organic light emitting diode EL_B of the second unit pixel portion 454 continues to emit light in sub-frames according to the first emission control signal.

In other words, the display region 410 includes a plurality of scan lines, a plurality of data lines, a plurality of emission control lines, and a plurality of power supply lines. Scan signals S1 to Sm from the gate drive circuit 430 are provided to the plurality of scan lines. Data signals DR1, DG1, DB1, to DRn, DGn, DBn from the data drive circuit 420 are provided to the plurality of data lines. The first emission control signals E11 to Em1 and the second emission control signals E12 to Em2 from the emission control signal generation circuit 440 are provided to the plurality of emission control lines. The plurality of power supply lines provide a source voltage ELVDD. The display region 410 further includes a plurality of the pixels 450 arranged in a matrix pattern, which are connected to the plurality of scan lines, the plurality of data lines, the plurality of emission control lines, and the plurality of power supply lines.

Here, the pixel 450 includes a plurality of organic light emitting diodes. The described embodiment is characterized in that among at least three organic light emitting diodes included in the pixel 450, those having a relatively longer life time use a time division drive method, and the remaining diodes having a relatively shorter life time use a general drive method. For this purpose, two emission control lines are connected to every pixel 450.

As one embodiment, in a pixel including R, G, and B organic light emitting diodes, the B organic light emitting diode having the shortest life time is driven by a general drive method, and R and G organic light emitting diodes having relatively longer life times are driven in a time division drive method. Accordingly, as described above, the pixel 450 includes a first unit pixel portion 452 and a second unit pixel portion 454. The first unit pixel portion 452 uses a time division drive method by sharing one pixel circuit between the R and G organic light emitting diodes having relatively longer life times. The second unit pixel portion 454 is configured by the B organic light emitting diode with the shortest life time, that does not use the time division drive method.

As one embodiment, a first scan signal S1 is applied to the pixel 450 through a first scan line, and R and G data signals DR1 and DG1 are sequentially provided to the pixel 450 through a first data line. While the R and G data signals are being sequentially provided, a B data signal DB1 is provided through a second data line, and first and second emission control signals E11 and E12 are provided through first and second emission control lines. As a result, emission times of first and second unit pixel portions 452 and 454 of the pixel 450 are controlled, and a predetermined power supply ELVDD is applied through a power supply line.

Accordingly, each time a scan signal is applied in sub-frames, corresponding R, G, and B data signals are applied to the respective pixels 450. The R, G, and B organic light emitting diodes are driven according to the emission control signals to emit light corresponding to the R, G, and B data signals, with the result that an image of a predetermined color is displayed for one frame.

However, in the described embodiment of the present invention, the first unit pixel portion 452 shared by organic light emitting diodes having a relatively longer life time, namely, the R and G organic light emitting diodes, are sequentially driven during a half of one frame period, namely, a sub-frame of one frame period, in a time division drive method. In contrast, the second unit pixel portion 454 including an organic light emitting diode with a shorter life time, namely, the B organic light emitting diode, is driven during every sub-frame, with the result that it is driven during one frame period. This may solve problems due to variation between the life times of the organic light emitting diodes without reducing an aperture ratio of the display region. Although the B diode is provided with a blue data signal during each sub-frame when either the R or the G diodes are being provided with their corresponding red or green data signals, because the B diode is controlled by the first emission control signal, it will emit light during the entire length of one frame period, while the first emission control signal is at an appropriate level.

That is, the B organic light emitting diode having a shorter life time emits light for one frame period, the R and G organic light emitting diodes having a relatively longer life time sequentially emit light during one half of one frame period. Accordingly, in order to emit the same luminance of light, a current density required by the B organic light emitting diode is less than the current density required by each of the R and G organic light emitting diodes. As a result, a difference between the life time of the B organic light emitting diode and each of the R and G organic light emitting diodes can be reduced.

In the embodiment of the present invention described above, the R and G organic light emitting diodes are driven by using a time division control drive method. This means that the R and G organic light emitting diodes share one pixel circuit, and are sequentially driven for one frame period.

That is, one frame is divided into two sub-frames, and the R and G organic light emitting diodes are sequentially driven every sub-frame through the shared pixel circuit, for one frame using a time division drive method. For example, if the time of one frame is divided between two sub-frames, the R organic light emitting diode is driven during one sub-frame and the G organic light emitting diode is driven during the other sub-frame.

Consequently, according to the present invention, the R and G organic light emitting diodes are sequentially driven in a time division drive manner during consecutive sub-frames of one frame. The B organic light emitting diode, on the other hand, continues to be driven for one frame period. As a result, respective pixels emit light of a predetermined color by a combination of R, G, and B colors to display an image.

In the embodiment of the present invention that has been explained above, each pixel includes R, G, and B organic light emitting diodes wherein the diodes are driven in an order of R and G organic light emitting diodes for two consecutive sub-frames of one frame to sequentially emit light of R and G colors, and the B Organic light emitting diode is driven in a general drive manner but not the time division drive manner, so that respective pixels may be embodied by predetermined colors. However, to adjust chromaticity, brightness or luminance, an emission order of the R, G, and B, organic light emitting diodes may be optionally changed. In other embodiments, the emission order may be R, G, B, and W. Otherwise, one frame is divided into at least three sub-frames and at least one of the R, G, and B colors can be further emitted during a remaining sub-frame.

Namely, for remaining unit pixel portions except a unit pixel portion including an organic light emitting diode having the shortest life time among the R, G, B, and W organic light emitting diodes, one frame is divided into a plurality of sub-frames, and this can be driven in a-time-division-drive manner. So, the unit pixel portion including the organic light emitting diode with the shortest life time is driven continuously during a frame period while the frame period is divided into sub-frames for driving the unit pixel portions including the organic light emitting diodes with relatively longer life times. These unit pixel portions are driven sequentially during the sub-frames such that the time of a frame is divided between them. Continuous driving indicates that an appropriate data signal is being provided to the unit pixel portion for all sub-frames of one frame period. Sequential driving indicates that data signals corresponding to different colors are provided to the unit pixel portions one after the other.

Figure 5:
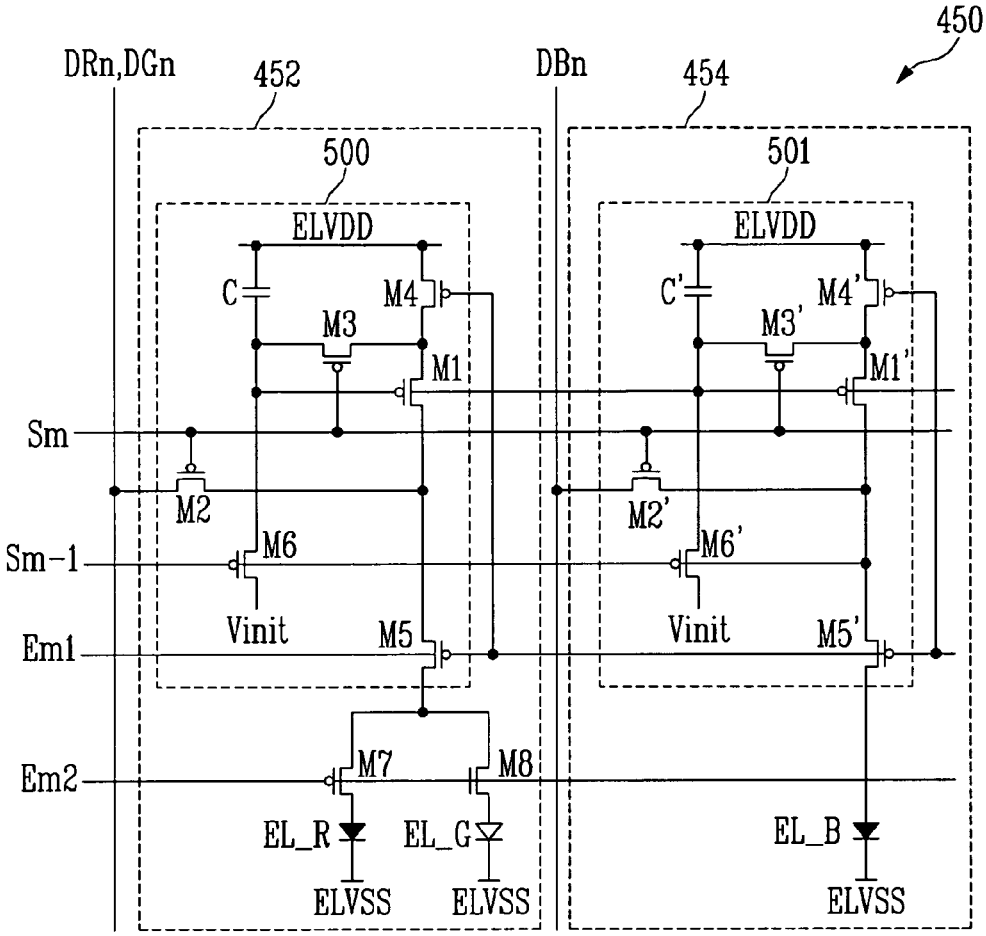
FIG. 5 is a view showing a circuit arrangement of a pixel that is formed at a display region of the organic light emitting display device of FIG. 4.
Figure 6:
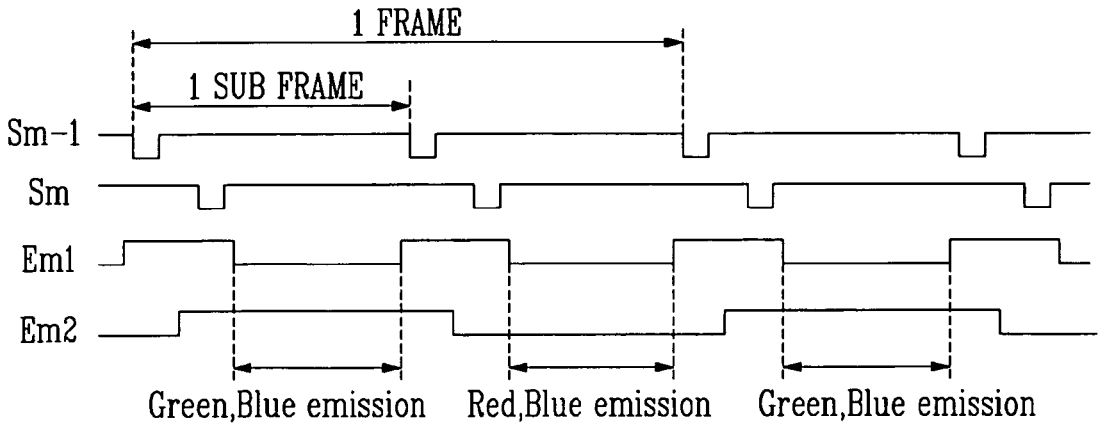
FIG. 6 is a timing chart for input/output signals of the pixel shown in FIG. 5.

FIG. 5 is a view showing a circuit arrangement of a pixel that is formed at a display region of the organic light emitting display device according to an embodiment of the present invention. FIG. 6 is a timing diagram for input/output signals of the pixel shown in FIG. 5.

The circuit arrangement of the pixel shown in FIG. 5 is an exemplary embodiment of the present invention, but the pixel is not limited to the arrangement shown.

With reference to FIG. 5, each pixel 450 of the organic light emitting display device according to an embodiment of the present invention includes a plurality of unit pixel portions. Each of the pixels is configured to be divided into the first unit pixel portion 452 and the second unit pixel portion 454 according to whether its organic light emitting diodes are driven with a time division driving method or not.

That is, as shown, assuming that the pixel includes the R, G, and B organic light emitting diodes, life times of the organic light emitting diodes are compared with each other. As the result of the comparison, the R and G organic light emitting diodes having relatively longer life time share one pixel circuit 500 and are configured as the first unit pixel portion 452 using a time division drive method. The B organic light emitting diode having a shorter life time is configured as the second unit pixel portion 454 that does not use the time division drive method.

Accordingly, the first unit pixel portion 452 is coupled with the first and second emission control lines. In the first unit pixel portion 452, R and G organic light emitting diodes sequentially emit light during consecutives halves of one frame, namely, in sub-frames responsive to the first and second emission control signals Em1 and Em2. In contrast, the second unit pixel portion 454 is coupled with the first emission control line, and a B organic light emitting diode in the second unit pixel portion 454 emits light responsive to the first emission control signal Em1 for one frame.

As shown in FIG. 6, the first emission control signal Em1 functions to cause the first and second unit pixel portions 452 and 454 to emit light in sub-frames, and the first emission control signal of a special level (low or high level) is provided during a predetermined period of the sub-frame period. The second emission control signal Em2 functions to cause the first unit pixel portion 452 to sequentially emit light in sub-frames wherein a voltage level thereof is inverted in sub-frames. So, the voltage level of the second emission control signal Em2 during one sub-frame is inverted with respect to the voltage level of the second emission control signal Em2 during a next sub-frame.

Since in the embodiment of the present invention that has been described above, the unit pixel portion includes a PMOS transistor, it is understood that the first emission control signal Em1 is provided during a predetermined time period as a low level. In other words, in the exemplary pixel 450 shown, the transistors receiving the first emission control signal Em1 at their gate terminals are depicted as PMOS transistors. As a result, a low level first emission control signal Em1 is used to turn these transistors on.

As described above, the B organic light emitting diode having a shorter life time emits light for one frame period, the R and G organic light emitting diodes having a relatively longer life time sequentially emit light during halves of one frame period. Accordingly, in order to emit the same luminance of light, a current density necessary for the B organic light emitting diode is less than a current density necessary for each of the R and G organic light emitting diodes, with the result that a difference between the life time of the B organic light emitting diode and each of the R and G organic light emitting diodes can be reduced.

Referring to FIG. 5, the pixel 450 includes two scan lines, two data lines, a first emission control line, and a second emission control line. The scan lines provide scan signals Sm and Sm-1. One of the data lines provides data signals DRn and DGn to the first unit pixel portion 452. The other data line provides a data signal DBn to the second unit pixel portion 454. The first emission control line is coupled to the first and second unit pixel portions 452 and 454 in common, and provides the first emission control signal Em1 thereto. The second emission control line is coupled to the first unit pixel portion 452, and provides the second emission control signal Em2 thereto. Power supply lines are coupled with the first and second unit pixel portions 452 and 454, and supply the first power supply ELVDD thereto.

Furthermore, the first unit pixel portion 452 includes the pixel circuit 500 for driving the R and G organic light emitting diodes. The second unit pixel portion 454 includes a pixel circuit 501 for driving the B organic light emitting diode. An anode electrode of each of the organic light emitting diodes is coupled with the pixel circuits 500, 501, and a cathode electrode of each diode is coupled with a second power supply ELVSS.

A voltage less than the voltage of the first power supply ELVDD, for example a ground voltage, is set as the second power supply ELVSS. Moreover, the organic light emitting diodes generate any one of red, green, and blue colors corresponding to an electric current provided from the pixel circuit 500, 501. The R and G organic light emitting diodes are included in the first unit pixel portion 452, and share the same pixel circuit 500.

The pixel circuit 500 includes a storage capacitor C, a first transistor M1, a second transistor M2, a third transistor M3, a fourth transistor M4, a fifth transistor M5, and a sixth transistor M6. The storage capacitor C and the sixth transistor M6 are coupled in series between the first power supply ELVDD and an initialization power supply Vinit. The fourth transistor M4, the first transistor M1, and the fifth transistor M5 are coupled in series between the first power supply ELVDD and an organic light emitting diode OLED. The third transistor M3 is coupled between a gate electrode and a first electrode of the first transistor M1. The second transistor M2 is coupled between a data line and a second electrode of the first transistor M1.

For each transistor, either a drain electrode or a source electrode is set as a first electrode, and an electrode other than the first electrode is set as a second electrode. For example, when the source electrode is set as the first electrode, the drain electrode is set as the second electrode.

The first to sixth transistors M1 to M6 are shown in FIG. 5 as PMOS transistors, but the present invention is not limited thereto. When the first to sixth transistors M1 to M6 are embodied by NMOS transistors, as known in the art, polarity of a drive waveform is inverted.

The second unit pixel portion 454, includes the pixel circuit 501. The pixel circuit 501 includes transistors M1', M2', M3', M4', M5', and M6' and the capacitor C' that are coupled together in substantially the same manner as their corresponding components of the pixel circuit 500. In the pixel circuit 501 of the second unit pixel portion 454, the second electrode of the transistor M1' is coupled with a B organic light emitting diode through the transistor M5'. A gate electrode of the transistor M1' is coupled to the storage capacitor C'. The transistor M1' provides an electric current corresponding to a voltage charged in the storage capacitor C', to the organic light emitting diode EL_B that is coupled to the pixel circuit 501.

In contrast, in the case of the first unit pixel portion 452, the pixel circuit 500 is coupled to the R and G organic light emitting diodes through a seventh transistor M7 and an eighth transistor M8, respectively. Since a second emission control line is further coupled to the first unit pixel portion 452 in order to sequentially drive the R and G organic light emitting diodes for one half of one frame, namely, during a sub-frame, the second electrode of the first transistor M1 is coupled with the R and G organic light emitting diodes through the fifth and seventh transistor M5 and M7 or the fifth and eighth transistors M5 and M8.

The structure of pixel circuit 500 will be described below. The structure of the pixel circuit 501 is substantially the same. In the pixel circuit 500 of the first unit pixel portion 452, a first electrode of the third transistor M3 is coupled with the first electrode of the first transistor M1, and a second electrode of the third transistor M3 is coupled with a gate electrode of the first transistor M1. A gate electrode of the third transistor M3 is coupled with an $m^{th}$ scan line. When a scan signal Sm is supplied to the $m^{th}$ scan line, the third transistor M3 is turned on, so that the first transistor M1 is diode-connected.

A first electrode of the second transistor M2 is coupled with a data line, and a second electrode thereof is coupled with the second electrode of the first transistor M1. A gate electrode of the second transistor M2 is coupled with the $m^{th}$ scan line receiving the scan signal Sm. When the scan signal Sm is provided to the $m^{th}$ scan line, the second transistor M2 is turned on, so that a data signal DRn or DGn supplied to the data line is supplied to the second electrode of the first transistor M1.

A first electrode of the fourth transistor M4 is coupled with the first power supply ELVDD, and a second electrode thereof is coupled with the first transistor M1. A gate electrode of the fourth transistor M4 is coupled with an emission control line receiving the first emission control signal Em1. When an emission control signal is not being supplied (i.e., when the signal is low), the fourth transistor M4 is turned on to electrically connect the first power supply ELVDD and the first transistor M1 to each other.

In the case of the second unit pixel portion 454, a first electrode of the transistor M5' is coupled with the transistor M1', and a second electrode of the transistor M5' is coupled with the B organic light emitting diode EL_B. A gate electrode of the transistor M5' is coupled with the first emission control line. When the first emission control signal Em1 of a low level is provided to the transistor M5', the transistor M5' is turned on, to electrically connect the transistor M1' and the B organic light emitting diode EL_B of the second unit pixel portion 454.

However, in the case of the first unit pixel portion 452, to sequentially drive the R and G organic light emitting diodes during one half of one frame, a second emission control line is further provided that receives the second emission control signal Em2.

Accordingly in the first unit pixel portion 452, the seventh transistor M7 is further provided between the fifth transistor M5 and the R organic light emitting diode, and the eighth transistor M8 is further provided between the fifth transistor M5 and the G organic light emitting diode.

In the exemplary embodiment shown in FIG. 5, the seventh transistor M7 is a PMOS transistor, whereas the eighth transistor M8 is an NMOS transistor. The purpose is to cause one of the two organic light emitting diodes not to emit light when one frame is divided into two sub-frames and while the other organic light emitting diode of the first unit pixel portion emits light.

Accordingly, the second emission control line is coupled with gate electrodes of the seventh and eighth transistors M7 and M8. The second emission control signal Em2 for sequentially driving the R and G organic light emitting diodes of the first unit pixel portion 452 is supplied to the second emission control line.

A second electrode of the sixth transistor M6 is coupled with the storage capacitor C and the gate electrode of the first transistor M1, and a first electrode of the sixth transistor M6 is coupled with the initialization power supply Vinit. Further, a gate electrode of the sixth transistor M6 is coupled with an $(m-1)^{th}$ scan line receiving a scan signal Sm-1. When the scan signal Sm-1 is supplied to the $(m-1)^{th}$ scan line, the sixth transistor M6 is turned on to initialize the storage capacitor C and the gate electrode of the first transistor M1. To do this, a voltage value of the initialization power supply Vinit is set to be less than that of a data signal.

Operation of the pixel 450 having the construction described above will be illustrated with reference to FIG. 6. During a predetermined time period of a first sub-frame, as the first emission control signal Em2 of a low level and the second emission control signal Em1 of a high level are supplied to the pixel, the green G organic light emitting diode of the first unit pixel portion 452 and the blue B organic light emitting diode of the second unit pixel portion 454 emit light concurrently. This period is shown as a Green, Blue emission period in FIG. 6.

Moreover, during a predetermined time period of the second sub-frame, as the first emission control signal Em1 of a low level and the second emission control signal Em2 of a low level are supplied to the pixel, the red R organic light emitting diode of the first unit pixel portion 452 and the blue B organic light emitting diode of the second unit pixel portion 454 emit light concurrently. This period is shown as a Red, Blue emission period on FIG. 6.

As a result, with reference to FIGS. 5 and 6, in the first unit pixel portion 452, one frame is divided into two sub-frames. Through the shared pixel circuit 500, the G and B organic light emitting diodes are sequentially driven by the first and second emission control signals Em1 and Em2 in a time division drive method for each sub-frame of one frame period. In the second unit pixel portion 454, the B organic light emitting diode is driven by the first emission control signal Em1 regardless of the time division drive method. Consequently, respective pixels emit light of predetermined color by a combination of R, G, and B colors, with the result that an image is displayed.

That is, in the embodiments of the present invention, the B organic light emitting diode having a shorter life time emits light for one frame period, and R and G organic light emitting diodes having relatively longer life time sequentially emit light each during one half of one frame. Accordingly, in order to emit the same luminance of light, a current density necessary for the B organic light emitting diode is less than that necessary for each of the R and G organic light emitting diodes, with the result that a life time difference between the B organic light emitting diode and each of the R and G organic light emitting diodes can be reduced.

As described above, according to the described embodiments of the present invention, organic light emitting diodes that have a relatively longer life time are driven using a time division drive method, whereas the remaining organic light emitting diodes having relatively shorter life times are driven using a general drive method. Problems due to differences between duration of life time of different organic light emitting diodes can be solved without reducing aperture ratio. Namely, white balance variation and image sticking phenomenon that are due to a difference in the degree of luminance reduction with passage of time in R, G, and B organic light emitting diodes may be solved.

Although certain exemplary embodiments of the present invention have been shown and described, it would be appreciated by those skilled in the art that changes might be made to these embodiments without departing from the principles and spirit of the invention, the scope of which is defined in the claims and their equivalents.

What is claimed is:

1. An organic light emitting display device comprising:

a gate drive circuit for generating scan signals and providing the scan signals to a plurality of scan lines;

a data drive circuit for providing data signals to a plurality of data lines when the scan signals are applied to the scan lines;

an emission control signal generation circuit for generating first and second emission control signals and providing the first and the second emission control signals to a plurality of emission control lines to control emission of organic light emitting diodes; and a display region including a plurality of pixels arranged in a matrix, the pixels coupled to the plurality of scan lines, the plurality of data lines, the plurality of emission control lines, and a plurality of power lines, wherein each of the plurality of pixels comprises a first unit pixel portion having a first pixel circuit and at least two of the organic light emitting diodes and a second unit pixel portion having a second pixel circuit and one of the organic light emitting diodes, and wherein the first unit pixel portion is configured to perform a time division control drive by sharing the first pixel circuit among the at least two of the organic light emitting diodes, and the second unit pixel portion is configured to drive the one of the organic light emitting diodes using the second pixel circuit while the first unit pixel portion is driving each of the at least two of the organic light emitting diodes, such that one frame is divided into sub-frames, the first unit pixel portion is configured to drive one of the at least two of the organic light emitting diodes while the second unit pixel portion is configured to drive the one of the organic light emitting diodes during a first sub-frame of the sub-frames, and the first unit pixel portion is configured to drive another one of the at least two of the organic light emitting diodes while the second unit pixel portion is configured to drive the one of the organic light emitting diodes during a second sub-frame of the sub-frames.

2. The organic light emitting display device according to claim 1, wherein the at least two of the organic light emitting diodes in the first unit pixel portion comprise organic light emitting diodes not having the shortest life times among the organic light emitting diodes in the pixels.

3. The organic light emitting display device according to claim 2, wherein the at least two of the organic light emitting diodes in the first unit pixel portion comprise a red organic light emitting diode and a green organic light emitting diode.

4. The organic light emitting display device according to claim 1, wherein the one of the organic light emitting diodes in the second unit pixel portion comprises an organic light emitting diode having the shortest life time among the organic light emitting diodes in the pixels.

5. The organic light emitting display device according to claim 4, wherein the one of the organic light emitting diodes in the second unit pixel portion comprises a blue organic light emitting diode.

6. The organic light emitting display device according to claim 1, wherein red and green data signals are provided in sequential sub-frames to data lines coupled to the first unit pixel portion among the plurality of data lines.

7. The organic light emitting display device according to claim 1, wherein a blue data signal is provided in one frame period to a data line coupled to the second unit pixel portion among the plurality of data lines.

8. The organic light emitting display device according to claim 1, wherein the first emission control signal of a low level is provided in the sub-frames when each of the first and the second unit pixel portions includes a PMOS transistor for receiving the first emission control signal, and wherein the first and the second unit pixel portions are configured to emit light in the sub-frames responsive to the low level of the first emission control signal.

9. The organic light emitting display device according to claim 1, wherein the first emission control signal of a high level is provided in the sub-frames when each of the first and the second unit pixel portions includes an NMOS transistor for receiving the first emission control signal, and wherein the first and the second unit pixel portions are configured to emit light in the sub-frames responsive to the high level of the first emission control signal.

10. The organic light emitting display device according to claim 1, wherein the first unit pixel portion is configured to sequentially emit lights having different colors responsive to the second emission control signal having a signal level being inverted in consecutive sub-frames.

11. The organic light emitting display device according to claim 1, wherein each of the pixel circuits comprises:

a storage capacitor and a sixth transistor coupled in series between a first power supply and an initialization power supply;

a fourth transistor, a first transistor, and a fifth transistor coupled in series between the first power supply and one of the organic light emitting diodes;

a third transistor coupled between a gate electrode and a first electrode of the first transistor; and a second transistor coupled between one of the plurality of data lines and a second electrode of the first transistor.

12. The organic light emitting display device according to claim 11, wherein the first, the second, the third, the fourth, the fifth, and the sixth transistors are PMOS transistors.

13. The organic light emitting display device according to claim 11, wherein the first unit pixel portion further comprises a seventh transistor, and an eighth transistor, the seventh and the eighth transistors respectively coupled between red and green organic light emitting diodes and the fifth transistor.

14. The organic light emitting display device according to claim 13, wherein the seventh transistor is a PMOS transistor, and the eighth transistor is an NMOS transistor.

15. The organic light emitting display device according to claim 13, wherein a second emission control line among the plurality of emission control lines is coupled to a gate electrode of the seventh transistor and a gate electrode of the eighth transistor, and the second emission control signal is provided to the second emission control line for sequentially driving the red and the green organic light emitting diodes of the first unit pixel portion.

16. The organic light emitting display device according to claim 1, wherein the one of the organic light emitting diodes is configured to emit light concurrently with emission of light of each of the at least two of the organic light emitting diodes, respectively.

17. The organic light emitting display device according to claim 1, wherein emission of the one of the organic light emitting diodes of the second unit pixel portion is configured to be controlled by a different number of emission control signals than emission of each of the at least two of the organic light emitting diodes of the first unit pixel portion.

18. The organic light emitting display device according to claim 1, wherein any two of the plurality of pixels comprises six of the organic light emitting diodes configured to be driven by four pixel circuits comprising at least one first pixel circuit and at least one second pixel circuit.

19. An organic light emitting display device comprising:

a gate drive circuit for generating scan signals and providing the scan signals to a plurality of scan lines;

a data drive circuit for providing data signals to a plurality of data lines when the scan signals are applied to the scan lines;

an emission control signal generation circuit for generating first and second emission control signals and providing the first and the second emission control signals to a plurality of emission control lines for controlling emission of organic light emitting diodes; and a display region including a plurality of pixels arranged in a matrix, the pixels coupled to the plurality of scan lines, the plurality of data lines, the plurality of emission control lines, and a plurality of power lines, wherein each of the plurality of pixels is divided into a first unit pixel portion and a second unit pixel portion according to whether the organic light emitting diodes in the first and the second pixel portions are driven time divisionally, such that one frame is divided into sub-frames, the first unit pixel portion of at least one of the pixels has at least two organic light emitting diodes while the second unit pixel portion of the at least one of the pixels has one organic light emitting diode, and the first unit pixel portion is configured to drive one of the at least two organic light emitting diodes while the second unit pixel portion is configured to drive the one organic light emitting diode during a first sub-frame of the sub-frames, and the first unit pixel portion is configured to drive another one of the at least two organic light emitting diodes while the second unit pixel portion is configured to drive the one organic light emitting diode during a second sub-frame of the sub-frames.

20. The organic light emitting display device according to claim 19, wherein the first unit pixel portion comprises a first pixel circuit shared between the at least two organic light emitting diodes, and wherein the one organic light emitting diode of the second unit pixel portion has a shortest life time among the organic light emitting diodes.

21. The organic light emitting display device according to claim 20, wherein the first unit pixel portion further comprises a plurality of transistors coupled respectively between the first pixel circuit and the at least two organic light emitting diodes, the plurality of transistors for receiving the second emission control signal.

22. The organic light emitting display device according to claim 19, wherein the first emission control signal is provided in a predetermined time period of the sub-frames as a signal having low or high level.

23. The organic light emitting display device according to claim 22, wherein the first emission control signal of the low level is provided when the unit pixel portions comprise a PMOS transistor for receiving the first emission control signal, and wherein the first emission control signal of the high level is provided when the unit pixel comprise an NMOS transistor for receiving the first emission control signal.

24. The organic light emitting display device according to claim 19, wherein the first unit pixel portion is configured to sequentially emit light in the sub-frames responsive to the second emission control signal, and wherein a signal level of the second emission control signal is inverted in consecutive sub-frames.

25. A method for driving an organic light emitting display device including a pixel having first and second unit pixel portions, the first unit pixel portion including a first pixel circuit shared by at least two organic light emitting diodes, and the second unit pixel portion including a second pixel circuit for driving one organic light emitting diode while the first unit pixel portion is driving each of the at least two organic light emitting diodes, the method comprising:

driving the first unit pixel portion by sequentially providing at least two data signals to the first unit pixel portion through a first data line in one frame; and driving the second unit pixel portion by providing a data signal, other than the at least two data signals provided to the first unit pixel portion, to the second unit pixel portion through a second data line in the one frame, wherein one frame is divided into sub-frames, the first unit pixel portion drives one of the at least two organic light emitting diodes while the second unit pixel portion drives the one organic light emitting diode during a first sub-frame of the sub-frames, and the first unit pixel portion drives another one of the at least two organic light emitting diodes while the second unit pixel portion drives the one organic light emitting diode during a second sub-frame of the sub-frames.

26. The method according to claim 25, wherein the sub-frames are formed by dividing the one frame into predetermined blocks of time.

27. The method according to claim 25, wherein the at least two organic light emitting diodes of the first unit pixel portion do not have a shortest life time among organic light emitting diodes of the organic light emitting display device.

28. The method according to claim 25, wherein the one organic light emitting diode of the second unit pixel portion has a shortest life time among organic light emitting diodes of the organic light emitting display device.

29. The method according to claim 25, wherein red and green data signals are sequentially provided to the first data line coupled to the first unit pixel portion.

30. The method according to claim 25, wherein a blue data signal is provided to the second data line coupled to the second unit pixel portion.

* * * * *

UNITED STATES PATENT AND TRADEMARK OFFICE

CERTIFICATE OF CORRECTION

PATENT NO. : 8,018,405 B2
APPLICATION NO. : 11/519730
DATED : September 13, 2011
INVENTOR(S) : Won-Kyu Kwak et al.

It is certified that error appears in the above-identified patent and that said Letters Patent is hereby corrected as shown below:

On the Title Page

| | |
|---|---|
| Item (75) Inventors, line 1. | Delete "Kvu"<br>Insert -- Kyu -- |
| Column 16, Claim 23, line 15. | Delete "pixel"<br>Insert -- portions -- |

Signed and Sealed this
Twenty-third Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,018,405 B2
APPLICATION NO. : 11/519730
DATED : September 13, 2011
INVENTOR(S) : Won-Kyu Kwak et al.

It is certified that error appears in the above-identified patent and that said Letters Patent is hereby corrected as shown below:

On the Title Page

Item (75) Inventors, line 1. Delete "Kvu"

Insert -- Kyu --

In the Claims

Column 16, Claim 23, line 15. After "pixel"

Insert -- portions --

This certificate supersedes the Certificate of Correction issued October 23, 2012.

Signed and Sealed this
Twenty-fourth Day of September, 2013

Teresa Stanek Rea
*Deputy Director of the United States Patent and Trademark Office*